US005429553A

United States Patent [19]

Schoeps

[11] Patent Number: 5,429,553

[45] Date of Patent: Jul. 4, 1995

[54] HYDRAULIC TORQUE IMPULSE GENERATOR

[75] Inventor: Knut C. Schoeps, Tyresö, Sweden

[73] Assignee: Atlas Copco Tools AB, Nacka, Sweden

[21] Appl. No.: 55,204

[22] Filed: Apr. 30, 1993

[30] Foreign Application Priority Data

May 5, 1992 [SE] Sweden ..... 9201405

[51] Int. Cl.[6] ..... B25B 21/02

[52] U.S. Cl. ..... 464/25

[58] Field of Search ..... 464/25; 173/93, 93.5; 81/463, 464, 465, 466

[56] References Cited

U.S. PATENT DOCUMENTS

| | | | |
|---|---|---|---|
| 4,767,379 | 8/1988 | Schoeps | 464/25 |
| 4,785,693 | 11/1988 | Minamivama et al. | 464/25 |
| 4,884,995 | 12/1989 | Schoeps . | |
| 4,920,836 | 5/1990 | Sigimoto et al. | 173/93.5 |
| 5,080,180 | 1/1992 | Tatsuno | 173/93.5 |

FOREIGN PATENT DOCUMENTS

| | | | |
|---|---|---|---|
| 267169 | 5/1988 | European Pat. Off. | 464/25 |
| 0460592A1 | 12/1991 | European Pat. Off. . | |

*Primary Examiner*—Daniel P. Stodola
*Assistant Examiner*—Eileen A. Dunn
*Attorney, Agent, or Firm*—Frishauf, Holtz, Goodman & Woodward

[57] ABSTRACT

A hydraulic torque impulse generator includes a motor driven drive member (10) with a fluid chamber (23), an output spindle (11) extending into the fluid chamber, two diametrically opposite seal elements (12, 13) movably supported in axial slots (32, 33) in the output spindle for sealing cooperation with seal lands (24, 25) on the fluid chamber wall, axially extending seal ribs (27–30) on both the fluid chamber wall and the output spindle, and a cam spindle (40) coupled to the drive member (10) and extending into a coaxial bore (34) in the output spindle for moving the seal elements outwardly towards the fluid chamber wall in two relative angular positions between the drive member and the output spindle. The cam spindle (40) has two diametrically opposite and differently shaped cams (41, 42) for alternative engagement with high and low lift cam followers (45–50) on the seal elements (12, 13). In one of the relative positions between the drive member and the output spindle, the seal elements are moved outwardly into sealing engagement with the seal lands, and in the other of the relative positions between the drive member and the output spindle, the seal elements are moved to positions where no sealing cooperation with the seal lands is obtained, thereby generating only a single torque impulse during each revolution of the drive member relative to the output spindle.

6 Claims, 2 Drawing Sheets

HYDRAULIC TORQUE IMPULSE GENERATOR

BACKGROUND OF THE INVENTION

This invention concerns a hydraulic torque impulse generator of the type, comprising a motor driven drive member with a fluid chamber an output spindle connectable to a work piece and extending into the fluid chamber, two diametrically opposite seal elements movably supported in axial slots in the output spindle for sealing cooperation with seal lands on the fluid chamber wall, axially extending seal ribs on both of said fluid chamber wall and said output spindle, and a cam spindle drivingly coupled to the drive member and extending into a coaxial bore in the output spindle for engagement with the seal elements.

In previously known torque impulse generators of the above type, valve means have been incorporated to short circuit the impulse generating seal means every second time they coincide to avoid more than one torque impulse being generated for each relative revolution between the drive member and the output spindle.

In U.S. Pat. No. 4,884,995 there is shown a hydraulic torque impulse generator of the above type in which the cam spindle is provided with passage forming grooves which in cooperation with radial openings in the output spindle form short circuiting passages between the high and low pressure compartments of the fluid chamber.

One problem with this prior art impulse generator is that the valve means on the cam spindle and the output spindle create leakage points which require a very tight fit between the cam spindle and the output spindle to avoid reduced impulse magnitudes due to leakage. Extra passage forming means on the cam spindle and the output spindle as well as a very accurate fit between these elements cause increased manufacturing costs for the impulse generator.

The object of the invention is to solve the above-described problem.

SUMMARY OF THE INVENTION

According to one aspect of the present invention, a hydraulic torque impulse generator comprises a drive member (10) connected to a rotation motor and including a fluid chamber (23) with a cylindrical circumferential fluid chamber wall, said fluid chamber wall having two seal lands (24, 25) thereon; an output spindle (11) connectable to a work piece and having a rear spindle portion extending into said fluid chamber (23) in a coaxial relationship with said drive member (10); said rear spindle portion having two diametrically opposite axial slots (32, 33); seal elements (12, 13) movably supported in respective ones of said axial slots (32, 33) for sealing cooperation with said two seal lands (24, 25) on said fluid chamber wall; a first set of two axially extending seal ribs (29, 30) on said output spindle (11) for sealing cooperation with a second set of two axially extending seal ribs (27, 28) on said fluid chamber wall; and a cam spindle (40) drivingly coupled to said drive member (10) and extending into a coaxial bore (34) in said output spindle (11) and arranged to engage said seal elements (12, 13) to move said seal elements outwardly towards said circumferential fluid chamber wall in two relative angular positions of said drive member (10) and said output spindle (11). The said cam spindle (40) comprises two differently shaped cams (41, 42) located diametrically opposite to one another. The said seal elements (12, 13) have correspondingly shaped inner cam following portions (43, 44) for cooperation with the cams (41, 42) such that:

in one of said two relative positions of said drive member (10) and said output spindle (11), said cams (41, 42) cooperate with said cam following portions (43, 44) to move said seal elements (12, 13) outwardly into positions well out of sealing cooperation with said seal lands (24, 25); and in the other of said two relative positions, said cams (41, 42) cooperate with said cam following portions (43, 44) to move said seal elements (12, 13) outwardly into positions in which a sealing cooperation with said seal lands (24, 25) is obtained.

According to another aspect of the present invention, a hydraulic torque impulse generator comprises a drive member (10) connected to a rotation motor and including a fluid chamber (23) with a cylindrical circumferential fluid chamber wall, said fluid chamber wall having two seal lands (24, 25) thereon; an output spindle (11) connectable to a work piece and having a rear spindle portion extending into said fluid chamber (23) in a coaxial relationship with said drive member (10); said rear spindle portion having two diametrically opposite axial slots (32, 33); seal elements (12, 13) movably supported in respective ones of said axial slots (32, 33) for sealing cooperation with said two seal lands (24, 25) on said fluid chamber wall; a first set of two axially extending seal ribs (29, 30) on said output spindle (11) for sealing cooperation with a second set of two axially extending seal ribs (27, 28) on said fluid chamber wall; and a cam spindle (40) drivingly coupled to said drive member (10) and extending into a coaxial bore (34) in said output spindle (11) and arranged to engage said seal elements (12, 13) to move said seal elements outwardly towards said circumferential fluid chamber wall in two relative angular positions of said drive member (10) and said output spindle (11). The cam spindle (40) comprises a first cam (41) and a second cam (42), said second cam (42) being located diametrically opposite to said first cam (41), each of said first cam and second cam (41, 42) including at least one cam lobe (51, 54, 55); the at least one cam lobe (54, 55) of said first cam (41) is axially separated from said at least one cam lobe (51) of said second cam (42); and each of the seal elements (12, 13) has a high lift cam follower (46–48) and a low lift cam follower (45, 49, 50), said high lift and low lift cam followers being separated from each other in the axial direction of said output spindle (11). The high lift cam follower (46, 47) of one of said seal elements (12) is axially separated from said high lift cam follower (48) of the other of said seal elements (13) and is aligned with said at least one cam lobe (54, 55) of said first cam (41), and the high lift cam follower (48) of the other of said seal elements (13) is aligned with said at least one cam lobe (51) of said second cam (42). The low lift cam follower (45) of said one of said seal elements (12) is axially separated from said low lift cam follower (49, 50) of the other of said seal elements (13) but is aligned with said at least one cam lobe (51) of said second cam (42), and the low lift cam follower (49, 50) of the other of said seal elements (13) is aligned with said at least one cam lobe (54, 55) of said first cam (41).

DETAILED DESCRIPTION

Figure 1:
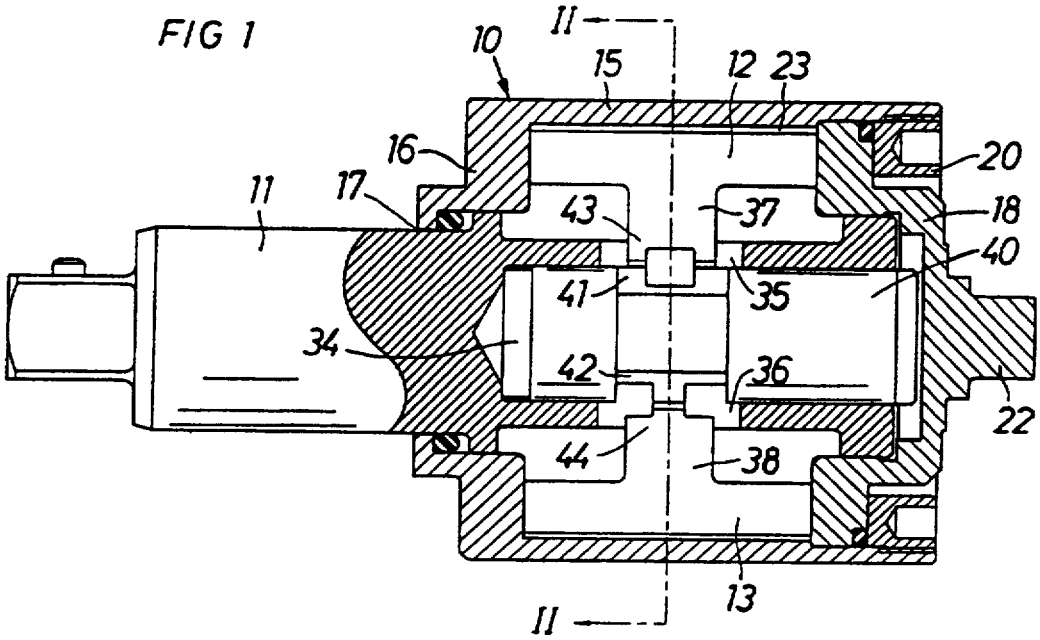
FIG. 1 shows a longitudinal section through an impulse generator according to the invention illustrating the seal elements in their impulse generating seal positions.

The hydraulic torque impulse generator shown in the drawing figures comprises a drive member 10, an output spindle 11 with a square end portion, and two movable T-shaped seal elements 12, 13.

Figure 3:
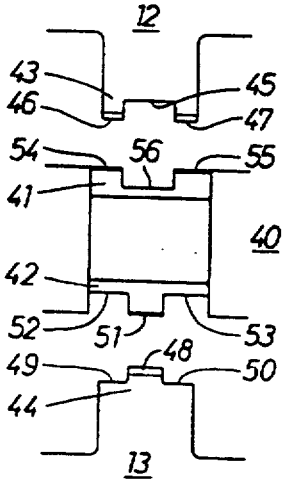
FIG. 3 shows an exploded schematic partial view of the cam and cam following means on the spindle and the seal elements, respectively, illustrating the high lift engagement position of the cam means as shown in FIG. 1.
Figure 4:
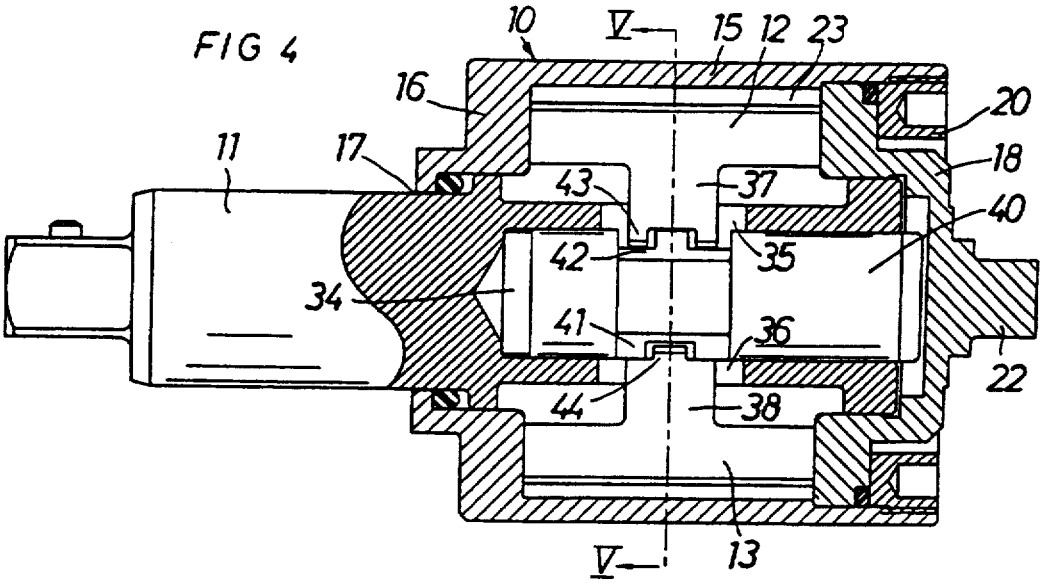
FIG. 4 is similar to FIG. 1, but illustrates the seal elements in their free running positions.

The drive member 10 includes a cylindrical main portion 15, a front end wall 16 with a central opening 17 for the output spindle 11 and a rear end wall 18 which is rotationally locked relative to the main portion 15 by a stud 19 (See FIGS. 3 and 4). The rear end wall 18 is formed with a stub axle 22 for connection to a drive motor (not shown) and is fixed to the main portion 15 by means of a ring 20 threaded into the main portion 15. The stub axle 22 may be square or hexagonal in cross section or may be provided with splines for intercoupling with a corresponding female coupling means on the motor shaft.

The drive member 10 further includes a cylindrical fluid chamber 23 into which the rear portion of the output spindle 11 extends. On the circumferential wall of the fluid chamber 23 there are two parallel, axially extending seal lands 24, 25 for sealing cooperation with the seal elements 12, 13, and two parallel, axially extending seal ribs 27, 28 for sealing cooperation with two corresponding seal ribs 29, 30 on the output spindle 11.

The output spindle 11 comprises two radially extending axial slots 32, 33 in which the seal elements 12, 13 are movably supported. Moreover, the output spindle 11 is formed with an axial bore 34 extending from its rear end and having radial openings 35, 36 for receiving the central stem portions 37, 38 of the T-shaped seal elements 12, 13.

A cam spindle 40 extends into the bore 34, and is at its rear end positively coupled to the drive member 10 for corotation therewith. The cam spindle 40 is formed with two differently shaped and diametrically opposite cam means 41, 42. One of the cam means is basically a reverse of the other.

As mentioned above, the seal elements 12, 13 are formed with central stem portions 37, 38 which extend into the bore 34 through the radial openings 35, 36 to engage the cam means 41, 42 of the cam spindle 40. Each of the seal element stem portions 37, 38 has a cam following portion 43, 44 for engagement with the cam means 41, 42. On one of the seal elements 12 the cam following portion 43 comprises a central low lift surface 45 surrounded by two high lift surfaces 46, 47, whereas the cam following portion 44 of the other seal element 13 comprises a central high lift surface 48 surrounded by two low lift surfaces 49, 50. See FIG. 3.

For cooperation with the cam following portions 43, 44 of the seal elments 12, 13, the cam means 41, 42 of the cam spindle 40 are formed with cam lobes of a configuration corresponding to the high and low lift surfaces of the cam following portions 43, 44. Accordingly, one of the cam means 41 comprises a central cam lobe 51 surrounded by two clearance grooves 52, 53, whereas the other cam means 41 comprises two cam lobes 54, 55 surrounding a central clearance groove 56. The cam lobes 51 and 54, 55, respectively, all have the same radial extent, but depending on which of the high or low lift surfaces on the cam following portions 43, 44 they actually engage, they accomplish a sealing cooperation between the seal elements 12, 13 and the seal lands 24, 25 on the fluid chamber wall or free running positons of the seal elements 12, 13.

Figure 2:
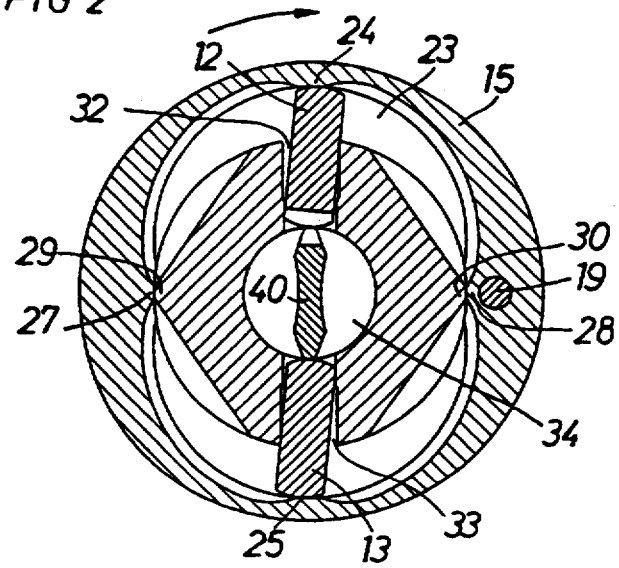
FIG. 2 shows a cross section along line II—II in FIG. 1.

In FIGS. 1,2, and 3, there is illustrated the impulse generating phase in which the seal elements 12, 13 are brought into contact with the seal lands 24, 25. This is obtained by a cooperation between the cam lobe 51 and the high lift surface 48 on the seal element 12 and between the cam lobes 54, 55 and the high lift surfaces 46, 47 on the seal element 13. In this phase, the low lift surfaces 45 and 49, 50 coincide with the clearance grooves 56 and 52, 53, respectively. See FIG. 3 which schematically shows the high lift engagement position of the cam lobes.

Figure 5:
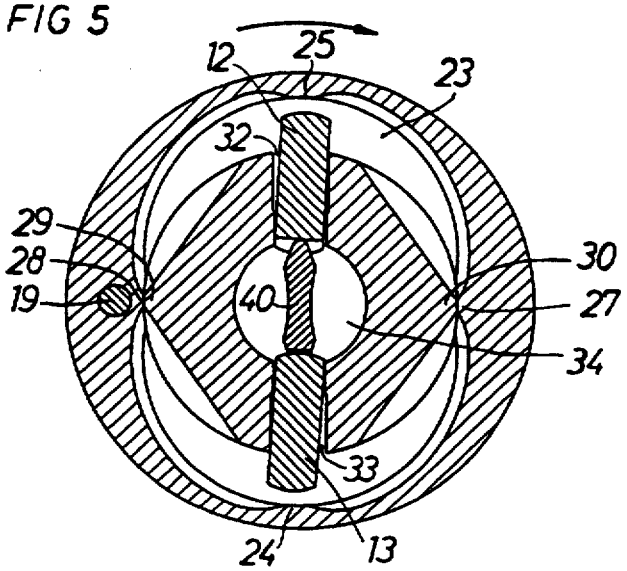
FIG. 5 shows a cross section along line V—V in FIG. 2.
Figure 6:
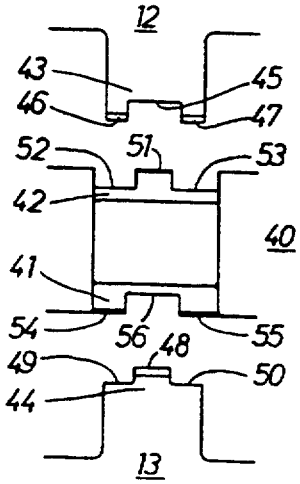
FIG. 6 is an exploded schematic partial view similar to FIG. 3, but illustrating the low lift position of the cam means shown in FIG. 4.

When a relative rotation of 180° has occurred between the drive member 10 and the output spindle 11, the free running phase takes place. This is illustrated in FIGS. 4, 5, and 6. In this phase, the cam lobes 51 and 54, 55 engage the low lift surfaces 45 and 49, 50, respectively, whereas the high lift surfaces 48 and 46, 47 coincide with the clearance grooves 56 and 51, 53, respectively, on the cam spindle 14. See FIG. 6 which schematically shows the low lift engagement position of the cam lobes.

In both phases, however, sealing cooperation is obtained between the seal ribs 27, 28 on the fluid chamber wall and the seal ribs 29, 30 on the output spindle 11.

The cam operation of the seal elements 12, 13 according to the invention is advantageous in that no extra valve forming means is needed to accomplish generation of only a single torque impulse per relative revolution between the drive member 10 and the output spindle 14.

It is to be noted that the invention is not limited to the above described embodiment, but can be varied within the scope of the claims. For example, the cam lobes of the cam spindle cam means as well as the cam following surfaces of the seal elements may be disposed otherwise. It is important to note though that the camming engagement between the cam spindle and the seal elements takes place symmetrically on the seal elements to avoid tilting and jamming thereof.

I claim:

1. A hydraulic torque impulse generator, comprising:

a drive member (10) connected to a rotation motor and including a fluid chamber (23) with a cylindrical circumferential fluid chamber wall, said fluid chamber wall having two seal lands (24, 25) thereon;

an output spindle (11) connectable to a work piece and having a rear spindle portion extending into said fluid chamber (23) in a coaxial relationship with said drive member (10);

said rear spindle portion having two diametrically opposite axial slots (32, 33);

seal elements (12, 13) movably supported in respective ones of said axial slots (32, 33) for sealing cooperation with said two seal lands (24, 25) on said fluid chamber wall;

a first set of two axially extending seal ribs (29, 30) on said output spindle (11) for sealing cooperation with a second set of two axially extending seal ribs (27, 28) on said fluid chamber wall; and a cam spindle (40) drivingly coupled to said drive member (10) and extending into a coaxial bore (34) in said output spindle (11) and arranged to engage said seal elements (12, 13) to move said seal elements outwardly towards said circumferential fluid chamber wall in two relative angular positions of said drive member (10) and said output spindle (11);

and wherein:

said cam spindle (40) comprises two differently shaped cams (41, 42) located diametrically opposite to one another; and said seal elements (12, 13) have correspondingly shaped inner cam following portions (43, 44) for cooperation with said cams (41, 42) such that:

in one of said two relative positions of said drive member (10) and said output spindle (11), said cams (41, 42) cooperate with said cam following portions (43, 44) to move said seal elements (12, 13) outwardly into positions well out of sealing cooperation with said seal lands (24, 25); and in the other of said two relative positions, said cams (41, 42) cooperate with said cam following portions (43, 44) to move said seal elements (12, 13) outwardly into positions in which a sealing cooperation with said seal lands (24, 25) is obtained.

2. The hydraulic torque impulse generator of claim 1, wherein:

one of said cams comprises a central cam lobe (51) surrounded by two clearance grooves (52, 53);

another of said cams comprises two cam lobes (54, 55) surrounding a central clearance groove (56);

said cam following portion (44) of one of said seal elements (13) comprises a central high lift surface (48) surrounded by two low lift surfaces (49, 50); and said cam following portion (43) of the other of said seal elements (12) comprises two high lift surfaces (46, 47) surrounding a central low lift surface (45).

3. The hydraulic torque impulse generator of claim 2, wherein said seal elements (12, 13) comprise T-shaped vanes, each T-shaped vane having a central stem portion (37, 38) extending into said coaxial bore (34) through radial openings (35, 36) in said output spindle (11) and being formed with said cam following portions (43, 44) thereon.

4. The hydraulic torque impulse generator of claim 1, wherein said seal elements (12, 13) comprise T-shaped vanes, each T-shaped vane having a central stem portion (37, 38) extending into said coaxial bore (34) through radial openings (35, 36) in said output spindle (11) and being formed with said cam following portions (43, 44) thereon.

5. A hydraulic torque impulse generator, comprising:

a drive member (10) connected toa rotation motor and including a fluid chamber (23) with a cylindrical circumferential fluid chamber wall, said fluid chamber wall having two seal lands (24, 25) thereon;

an output spindle (11) connectable to a work piece and having a rear spindle portion extending into said fluid chamber (23) in a coaxial relationship with said drive member (10);

said rear spindle portion having two diametrically opposite axial slots (32, 33);

seal elements (12, 13) movably supported in respective ones of said axial slots (32, 33) for sealing cooperation with said two seal lands (24, 25) on said fluid chamber wall;

a first set of two axially extending seal ribs (29, 30) on said output spindle (11) for sealing cooperation with a second set of two axially extending seal ribs (27, 28) on said fluid chamber wall; and a cam spindle (40) drivingly coupled to said drive member (10) and extending into a coaxial bore (34) in said output spindle (11) and arranged to engage said seal elements (12, 13) to move said seal elements outwardly towards said circumferential fluid chamber wall in two relative angular positions of said drive member (10) and said output spindle (11);

and wherein:

said cam spindle (40) comprises a first cam (41) and a second cam (42), said second cam (42) being located diametrically opposite to said first cam (41), each of said first cam and second cam (41, 42) including at least one cam lobe (51, 54, 55);

said at least one cam lobe (54, 55) of said first cam (41) is axially separated from said at least one cam lobe (51) of said second cam (42);

each of said seal elements (12, 13) has a high lift cam follower (46–48) and a low lift cam follower (45, 49, 50), said high lift and low lift cam followers being separated from each other in the axial direction of said output spindle (11);

said high lift cam follower (46, 47) of one of said seal elements (12) is axially separated from said high lift cam follower (48) of the other of said seal elements (13) and is aligned with said at least one cam lobe (54, 55) of said first cam (41), and said high lift cam follower (48) of the other of said seal elements (13) is aligned with said at least one cam lobe (51) of said second cam (42); and said low lift cam follower (45) of said one of said seal elements (12) is axially separated from said low lift cam follower (49, 50) of the other of said seal elements (13) but is aligned with said at least one cam lobe (51) of said second cam (42), and said low lift cam follower (49, 50) of the other of said seal elements (13) is aligned with said at least one cam lobe (54, 55) of said first cam (41).

6. The hydraulic torque impulse generator of claim 5, wherein said seal elements (12, 13) comprise T-shaped vanes, each T-shaped vane having a central stem portion (37, 38) extending into said coaxial bore (34) through radial openings (35, 36) in said output spindle (11) and being formed with said cam following portions (43, 44) thereon.

* * * * *